US011589681B2

(12) United States Patent
Ahuja

(10) Patent No.: US 11,589,681 B2
(45) Date of Patent: Feb. 28, 2023

(54) EARTHQUAKE PROTECTION BED APPARATUS AND SYSTEM THEREOF

(71) Applicant: Pulkit Ahuja, New Delhi (IN)

(72) Inventor: Pulkit Ahuja, New Delhi (IN)

( * ) Notice: Subject to any disclaimer, the term of this patent is extended or adjusted under 35 U.S.C. 154(b) by 0 days.

(21) Appl. No.: 17/482,794

(22) Filed: Sep. 23, 2021

(65) Prior Publication Data

US 2022/0257026 A1 Aug. 18, 2022

(51) Int. Cl.
*A47C 31/00* (2006.01)
*A47C 29/00* (2006.01)

(52) U.S. Cl.
CPC ..... *A47C 31/002* (2013.01); *A47C 29/003* (2013.01)

(58) Field of Classification Search
CPC ..... A47C 29/00; A47C 29/003; A47C 31/002
See application file for complete search history.

(56) References Cited

U.S. PATENT DOCUMENTS 4,782,541 A * 11/1988 Tuchman ..... A47C 31/002 403/166
4,965,895 A * 10/1990 Shustov ..... A47C 31/002 5/2.1
5,111,543 A * 5/1992 Epshetsky ..... A47C 31/002 5/1
5,575,024 A * 11/1996 You ..... A47C 31/002 5/424
5,878,449 A * 3/1999 Belenky ..... A47C 31/002 5/1
6,360,384 B1 * 3/2002 Kuempel ..... A61G 7/052 5/414
7,137,881 B2 * 11/2006 Walling ..... A47C 31/002 454/251
11,248,878 B2 * 2/2022 Klein ..... F41H 5/24
11,259,646 B2 * 3/2022 Blackett ..... A47C 21/04
2007/0192955 A1 * 8/2007 Matoba ..... A47C 31/002 5/1

FOREIGN PATENT DOCUMENTS

CN 101597968 A * 12/2009 ..... A47C 31/002
CN 102068145 B * 2/2013 ..... A47C 31/002
CN 107647685 A * 2/2018

* cited by examiner

*Primary Examiner* — David R Hare
(74) *Attorney, Agent, or Firm* — Kenyon Jenckes

(57) ABSTRACT

An earthquake protection apparatus and a system thereof. The apparatus includes a U-shaped frame further including a plurality of rods to be attached around periphery of the bed. The apparatus also includes a reinforced material fixed with the rods. The material has a tensile strength enough to bear the weight and slide off any falling debris on any side of the apparatus due to the earthquake. The material is configured to fold and unfold respectively upon triggering of a plurality of motors linked to earthquake detection sensors within the apparatus.

20 Claims, 10 Drawing Sheets

EARTHQUAKE PROTECTION BED APPARATUS AND SYSTEM THEREOF

CROSS-REFERENCE TO RELATED APPLICATIONS

This application claims priority to Indian Patent Application No. 202111006549 filed Feb. 17, 2021, and entitled, "AN EARTHQUAKE PROTECTION BED APPARATUS AND SYSTEM THEREOF", the entire contents of which are incorporated herein.

TECHNICAL FIELD

The present disclosure generally relates to the field of earthquake protection systems. More specifically, the present disclosure relates to an earthquake protection bed system which automatically encloses the bed with a reinforced slant canopy upon sensing seismic movements related to an earthquake, and slides off any debris which might damage or cause loss of life.

BACKGROUND

Earthquakes, also known as tremors, occur due to trembling of the surface of the Earth as a consequence of sudden release of seismic energy waves in Earth's lithosphere. There are approximately 15,000 earthquakes that occur worldwide every year. The higher the magnitude of the earthquake (>6.0), the higher the risk is. There are different types of earthquakes, and can be of relatively high, medium and negligible magnitude. There have been many deadly earthquakes worldwide which have caused numerous deaths and injuries due to damage to buildings and release of debris over the residents. Such earthquakes and their impact have been on a rise over a period of time due to continuous changes in nature, rapid construction, ageing of buildings, geological faults, among other factors. The tremors can hit unsuspecting areas unpredictably irrespective of time.

Many conventional systems and measures have been devised to escape injury and damage of earthquake especially when the residents are sleeping on a bed. Some of the conventional arts are too complex to use, and are one time use only. Hence, such systems may be demolished when deployed even for a single use. Some of the conventional systems are bulky. Some of these systems require manual assistance to operate. Some systems are fixed and static, for example, providing a fixed canopy or roof over the bed. Thus, such systems have to be designed specifically involving a roof on the bed at all times. A user may have no choice but to purchase such designs even though he or she might not find them an ideal fit. In addition, the fixed canopy or roof may be less efficient to bear the load of falling debris, and may break as more debris accumulates on the canopy.

Another conventional system employs the opening and closing of a canopy over the bed automatically. The opening and closing is done manually or automatically, depending on the system. Both the types involve complicated mechanisms, and a large number of equipment, which may unnecessarily add discomfort and cost to a user. Existing anti-earthquake canopies or roofs over the bed allow the debris to just keep on collecting, and there is no provision of disposal thereof. Hence in case of high rise buildings inflicted with multiple tremors where there is a high chance of more debris to fall onto beds in the lower floors of the buildings, chunks of the debris may accumulate on the roofs of such anti-earthquake systems, making them prone to breakage and thus harming the users underneath.

One of the well-known conventional arts provides an earthquake protection system which senses the vibrations generated due to earthquake. The system includes a mattress on a bed which drops into a secure chamber. Such a sudden dropping of the mattress can cause physical injury to a sleeping person or put him in a sudden mental shock. Such systems may be unsuitable for the elderly, patients suffering from spine related problems, etc. Moreover, it may be scary for small children sleeping under such systems. Furthermore, it may be suffocating for the person dropped inside the chamber especially during an earthquake of higher magnitude. It may become more strenuous when debris just keeps on depositing on the chamber. It becomes very difficult for the person to come out of the chamber when the seismic event is over.

The conventional systems are not adaptable to various different sizes or shapes of beds. Hence, a user has to procure an entire system of earthquake protection along with the bed. It may be problematic when the user has to replace the bed with a new one. There are no anti-earthquake systems which can be employed or be retrofitted on an ordinary preexisting bed. Especially, there are hardly any systems which can protect people sleeping on bunk beds. In addition, there may be false positives or proxy movements such as high volume of speakers, vibrating windows, jumping or movement of people on the bed or the floor nearby, passage of heavy vehicles, etc. causing sensational vibrations in the floor. In such scenarios, there is high likelihood of the conventional systems to be activated with false positives thereby wrongly sensing any movement as an earthquake.

Therefore, there exists a need for developing earthquake protection systems and apparatus which can be fit to any size or shape of any ordinary bed, and also allow automatic instant disposal of the debris while having the capability of detecting and communicating the occurrence of on earthquake remotely.

SUMMARY

One object of the present disclosure is to provide an earthquake protection bed system which can automatically sense seismic tremors and get activated to house the bed, providing automated protection during event of seismic tremors of earthquake or other natural calamity. The system includes a solid frame with a foldable high tensile resilient material attached thereof, a plurality of motors sensing and activating the frame to raise and lower, and an attached or remotely placed sensor box, a manual deployment, an automatic mode selector and an override switch. The frame is configured to be attached on the periphery of the bed via the high tensile strength foldable material.

Another object of the present disclosure is to provide an earthquake protection apparatus which can be fit on any ordinary bed irrespective of shape and size thereof.

Another object of the present disclosure is to provide an earthquake protection bed system and an apparatus which can dispose of the debris instantly as the debris falls from the above or sides towards the bed.

Another object of the present disclosure is to provide an earthquake protection bed system and apparatus which can either detect or design wise be immune from false positives and general vibrations, differentiating thereof from the true seismic tremors and operating accordingly.

Another object of the present disclosure is to provide a reusable earthquake protection bed and apparatus which can be automatically configured to be used again after the deployment.

Another object of the present disclosure is to provide a method for operating the earthquake protection system and an apparatus either through remote sensors or attached sensors.

In one embodiment, an earthquake bed protection apparatus is disclosed. The apparatus includes either single or a plurality of solid U-shaped frames, a reinforced material canopy enclosing the frame on one end and attached with the bed on the other end.

The material is in a folded configuration in the rest state, and in an unfolded configuration comprising a sliding canopy when activated. The apparatus includes at least one motor attached to the solid frame and in communication with a sensory box in proximity or remotely via wireless communication thereto. The motors are synchronized together to trigger the solid frame.

The sensory box is either disposed in proximity to the motors or connected to them wirelessly from a remote location. The box includes a plurality of the sensors in communication with the motors, microcontroller and printed circuit board, an accelerometer, Wi-Fi or SIM module, a backup battery and connections thereof.

The apparatus is removably attached to a bed under protection from effects of earthquake. The U-frame includes multiple fixed rods. In some embodiments, the U-frame includes multiple telescopic rods and the apparatus contains a plurality of frames. The motors are rechargeable, live power controlled with a battery-powered backup for operation during power cuts. The motors receive the seismic sensory activation signals from the sensory box, and further activate the frame to unfold the material thereby forming a slanted canopy. The sensory box includes PCBs and multiple sensors. The sensors may include such as but are not limited to gyro sensor, accelerometer, a multi-directional tunnel movement, electrostatic capacity acceleration sensor, seismic sensors, vibration sensors, system on module, system on chips, a processor and any combination thereof.

In some aspects, the motors are activated remotely through a wireless or wired signal from close or distant proximity. In some aspects, the motors are activated remotely through a wireless sensory box or via machine learning powered remote monitoring app which might be linked to and controlled by a central earthquake early warning and detection system.

In some embodiments, the motors may be replaced by at least one battery backed hydraulic lifts in sync with each other and linked with the same sensory box. This would enable higher weight frames to be lifted easily in case of bigger sized beds.

In some aspects, the motors or hydraulic lifts can be replaced by battery backed linear actuators in sync with each other thereby providing more strength and smoother movement of the U-frame and the material through the air. The linear actuators would be triggered by the same sensory box as in the case of motors which the linear actuators are replacing.

The bed includes such as but not limited to a single bed, a double bed, a double-decker bed, a triple-decker bed, a bunk bed, a quadruple decker bunk bed, a sofa-cum bed, an expandable bed, a foldable bed, a chair cum bed, a table cum bed, a hospital bed, a mounted bed, a crib, and combinations thereof. In some aspects, a remotely placed wireless sensor unit to control the apparatus lies in proximity thereto.

In another embodiment, an earthquake bed protection system is disclosed. The system includes an ordinary bed, a solid U-shaped frame lining around the periphery of the bed. The frame is in parallel axis with the bed in a rest state, and in perpendicular axis to the bed in an active state. The frame is attached with or enclosed within a reinforced material placed beneath the frame in a folded configuration in the rest state, and in an unfolded configuration comprising a sliding canopy in the active state. At least one motor are in conjunction with the frame and a sensory box, the motors being synchronized together to trigger the frame by causing rotation in opposite directions. The system includes the sensory box disposed in proximity to the motors.

The box houses PCBs and multiple sensors in communication with the motors, a microcontroller, and an accelerometer, a printed circuit board, Wi-Fi or SIM module, a backup battery and connections thereof. The system is reusable. In some embodiments, a remotely placed Wi-Fi and 4G/5G enabled sensory reception box can replace the sensory box. In such an embodiment, the system has the option to receive activation signals from a remote sensor box wirelessly.

The remote sensor box is a remotely placed box having an advantage of lesser vibrations or movements from usage of the bed. The motors are configured to receive activation signals from the sensory box, and further activate the frame to unfold the material. In some embodiments, a remotely placed Wi-Fi and 4G/5G enabled sensory reception box can receive activation signals for the activation of motors through a wireless sensory box or via machine learning powered remote monitoring app that might be linked to a central earthquake early warning and detection system. In some embodiments, the motors may be replaced by at least one AC/DC powered battery backed hydraulic lifts in sync with each other. This would enable higher weight frames to be lifted and held upright easily in case of bigger sized beds. The hydraulic lifts are linked with the sensory box or sensory reception box receiving activation signals from a remote sensor box wirelessly or via machine learning powered remote monitoring app that might be linked to a central earthquake early warning and detection system.

In some aspects, the motors or hydraulic lifts can be replaced by AC/DC powered battery backed linear actuators in sync with each other thereby providing more strength and smoother movement of the U-frame and the high tensile strength canopy material through the air. The linear actuators would be triggered by the sensory box or sensory reception box receiving activation signals from a remote sensor box wirelessly or via machine learning powered remote monitoring app that might be linked to a central earthquake early warning and detection system.

The bed includes such as but not limited to a single bed, a double bed, a double-decker bed, a triple-decker bed, a bunk bed, a quadruple bunk bed, a sofa-cum bed, an expandable bed, a foldable bed, a chair cum bed, a table cum bed, a hospital bed, a mounted bed, a crib, and combinations thereof.

In yet another embodiment, a method for protecting a bed from casualties due to earthquake through the earthquake protection apparatus attached to the bed is disclosed. The apparatus can be activated automatically and/or manually. The method includes a number of steps; sequence thereof may be exemplary for understanding of the persons skilled in the art.

The method includes sensing seismic vibrations, followed by detecting and differentiating true tremor occurrences from human dependent vibrations or movements. The method further involves detecting true vibration occurrences and initiating a cycle of triggering the motors else remaining idle at step in case of false positives.

In some aspects, the method includes sensing seismic vibrations through a remote-controlled activation signal receiver and a sensory box. The sensors included in the sensory box are configured to feed information to earthquake detection algorithms in communication with the motors, a microcontroller, and the accelerometer, a printed circuit board, Wi-Fi or SIM module, a backup battery and connections thereof. The method further involves triggering motors to provide proportionate rotational movement in counter directions while being synchronized till the U-frame is deployed perpendicularly to the base of the bed. The method also includes activating the frame to be raised until the frame is in axis with upright back of the bed and the reinforced material transitioned from the folded orientation of the rest state into the unfolded orientation of slanted canopy in the active state. The method finally involves enclosing the bed to be protected within the unfolded material based sliding canopy. Further, as the motors deactivate, the frame can be unlocked and lowered down to be in parallel axis with the periphery of the bed, and the high tensile strength material can be folded beneath the frame.

The method involves deactivating the motors and unlocking the frame from activated position to transition the frame into the rest state from the active state when the event of earthquake is over. The method also involves activating the apparatus through a wireless sensory box or via machine learning powered remote applications linked with a central early warning system. The method further includes extending rods of the frame telescopically to accommodate the apparatus as per size and shape of the bed. The method includes automatic sliding of the debris off from the canopy.

BRIEF DESCRIPTION OF THE DRAWINGS

Other objects, features, and advantages of the embodiment will be apparent from the following description when read with reference to the accompanying drawings. In the drawings, wherein like reference numerals denote corresponding parts throughout the several views.

DETAILED DESCRIPTION

Figure 1:
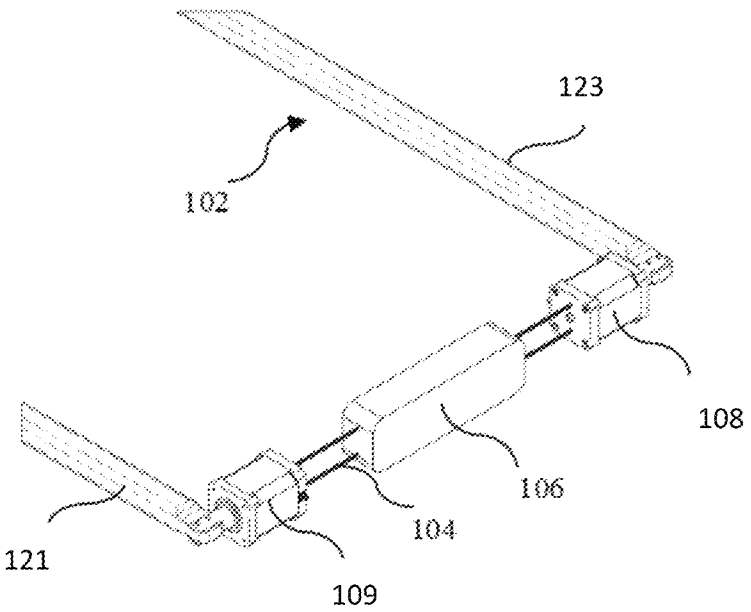
FIG. 1 is a perspective view of an earthquake protection apparatus according to an embodiment.

FIG. 1 shows a portion of an earthquake protection apparatus 100 according to an embodiment. The apparatus 100 is configured to be deployed on a sleeping platform such as a bed. The apparatus 100 includes a canopy frame 102.

The canopy frame 102 is preferably has a U-shape, however the shape thereof is not limited as the frame 102 can be of shape corresponding to the shape of the bed, for example, triangular, oval, circular, and so on. The frame 102 further includes a plurality of rods 121, 122 (shown in FIG. 4A), and 123. The rods 121, 122, 123 can be disposed along periphery of the bed. For example, 121 and 123 may be in parallel, with 122 perpendicular thereto such that exemplary U-shaped frame can be formed therefrom. In some embodiments, the rods 121, 122, 123 may be telescopic such that each of the rods 121, 122, 123 can extend to a certain limit depending upon the requirements, and collapse to shrink to a shorter length. Such rods 121, 122, 123 can be twisted manually to collapse and extend. In some aspects, twisting of the rods 121, 122, 123 can be controlled by a switch which may be pressed to enable the rods 121, 122, 123 to extend and collapse. In such aspects, the telescopic rods 121, 122, 123 includes a number of rods of varying diameter disposed therein, for example, rod A of A1 diameter covered by another rod B of B1 diameter wherein B1>A1, and so on. Such telescopic rods 121, 122, 123 may be configured to be accommodated to fit any size and type of the bed. For example, same frame 102 can be deployed on a double bed of standard king or queen size, and rods 121, 122, 123 thereof can be collapsed to be deployed on a single bed. In some aspects, the rods 121, 122, 123 constitute the integrated and unified frame 102. However in some embodiments, the rods 121, 122, 123 may be disintegrated. In some aspects, the diameter of the rods 121, 122, 123 may be varying such that the rod 122 may be of slightly greater diameter than that of the rods 121, 123, and the rods 121, 123 may be tucked into shoulders of the rod 121. In some aspects of telescopic rods, the rod 122 may be extended or collapsed while keeping length of the rods 121, 123 intact. However depending upon the customer requirements, the rods 121, 123 may also be individually extended or collapsed.

Figure 3:
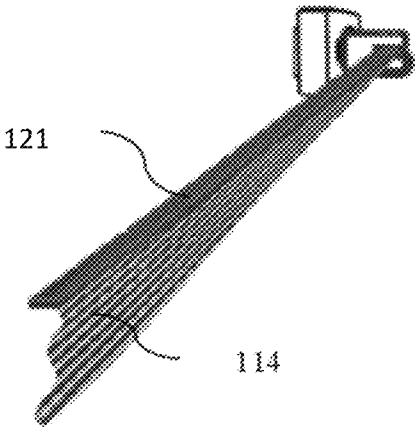
FIG. 3. is a perspective view of engagement of a resilient material of a canopy with the rods according to an embodiment.

The rods 121, 122, 123 includes a reinforced material 114 disposed beneath the rods 121, 122, 123 as shown in FIG. 3. The material 114 may include a material which is reinforced and tensile enough to bear a load of debris falling thereon. Examples of such material 114 may include such as but not limited to interweaved carbon fibre, and/or any other material accompanied with such properties already known in the art. The material 114 may further include a Kevlar hybrid mesh sandwiched between the carbon fibre clothes. Such an arrangement makes the material 114 robust enough to save the bed and the person sleeping on the bed from the debris falling thereon due to seismic vibrations of earthquake.

As shown in FIG. 3, the material 114 is attached beneath the rods 121, 122, 123 in a folded configuration in a rest state. The "rest state" defines a state of the apparatus 100 uncovering the bed during no event of seismic vibration occurrence. The folded configuration includes such as but not limited to ripple fold, S-fold, wave fold, and any other folds existing in the art. The material 114 is configured to unfold as the frame 602 raise raising and lowering thereof and forms a canopy 702 in active state as shown in various stages in FIGS. 6A-6D and FIGS. 7A-7F respectively. The active state defines the state of event of seismic vibrations, and may be fully active when the rod 122 is in parallel to back of the bed, and the rods 122, 123 are perpendicular to the back of the bed. Such a stage forms the triangular canopy 702 with sliding walls. Hence, as the debris falls on the canopy 702, the debris slides off along the sliding walls automatically and instantly. The canopy 702 houses the bed, thereby protecting the bed and anyone sleeping thereon. As shown in FIGS. 6A-6D and 7A-7F, the rods 121, 122, 123 and the material 114 tend to raise from 0 degrees until 90 degrees, and tend to lower from 90 degrees to 0 degrees.

In accordance to the embodiment of telescoping rods 121, 122, 123, the material 114 may also be collapsed and extended. The material 114 may have extended length by fastening another material of required length to the basic material 114. Such a fastening may include mechanisms such as but not limited to Velcro, zipper, sewing with thread, pasting, and/or any other mechanism available in the art. The material 114 may be of same length as compared to that of the rods 121, 122, 123.

Returning to FIG. 1, the apparatus 100 also includes at least two motors 108, 109 in anti-synchronization with each other such that if the motor 108 operates in clockwise direction then other motor 109 operates in counter-clockwise direction. The motors 108, 109 may be activated as the motors 108, 109 receive signals of true vibrations from a sensor box 106 equipped with a number of components including such as but are not limited to a number of sensors, accelerometer, and microcontroller. The sensors may further include such as but not limited to a gyro sensor, multi-directional tunnel movement, seismic, vibration, and/or any combinations or individually existing in the art. The sensors may be configured to sense seismic vibrations. The accelerometer sensor is configured to measure the acceleration forces acting on the apparatus 100 and the bed. The microcontroller includes a microprocessor which is a chipset with custom PCB and embedded within the sensor box 106 which controls the functions of each of the elements of the sensor box 106. The microprocessor may include such as but not limited to CISC, RISC, EPIC, and/or combinations or individually existing in the art.

In some embodiments, the motors may be replaced by at least one AC/DC powered battery backed hydraulic lifts in sync with each other and linked with the sensor box 106. This would enable higher weight frames to be lifted easily in case of bigger sized beds.

In some aspects, the motors or hydraulic lifts can be replaced by AC/DC powered battery backed linear actuators in sync with each other thereby providing more strength and smoother movement of the U-frame (102) and the high tensile strength canopy material through the air. The linear actuators would be triggered by the sensory box.

Figure 2:
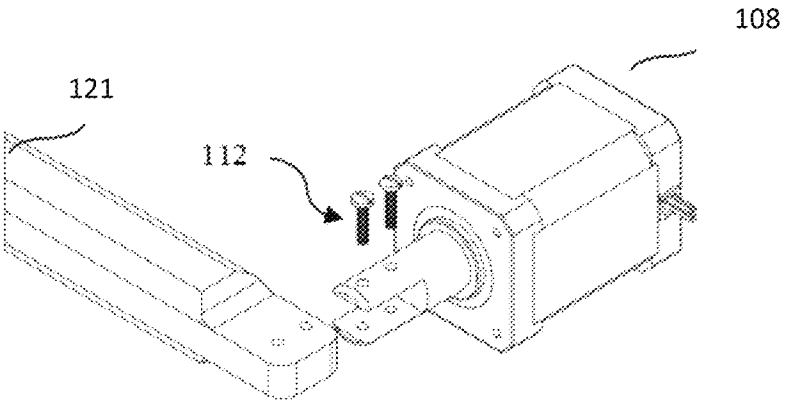
FIG. 2 is a perspective view of fastening of motors with the rods of the earthquake protection apparatus according to an embodiment.

The sensor box 106 may be attached to the motors 108, 109 through wires 104 such that the sensor box 106 is in middle of the two motors 108, 109, communicating with thereto. Another end of each of the motors 108, 109 may be attached to free ends of each of the rods 121, 123 respectively as shown in FIG. 2 through a fastening mechanism including such as but not limited to exemplary screw 112, hex bolts, lag bolts, carriage bolts, eye bolts, set screws, J-bolts, U-bolts, shoulder bolts, elevator bolts, bolt and nuts, rivets, anchor fasteners, inserts, snap rings, clevis pins and cotter pins, and/or any combinations existing in the art.

Upon activation of the motors 108, 109, the frame 102 along with the rods 121, 122, 123, and the material 114 tend to rise. However, as the event of earthquake gets over, the frame 102 along with the rods 121, 122, 123, and the material 114 tend to lower down from 90 degrees to 0 degree as the motors 108, 109 deactivate.

In some embodiments, the motors 108, 109 are rechargeable battery powered. The motors 108, 109 and the sensor box 106 may be charged through AC through a power socket. In some aspects, motors 108, 109 and the sensor box 106 may be charged through AC.

Figure 4A:
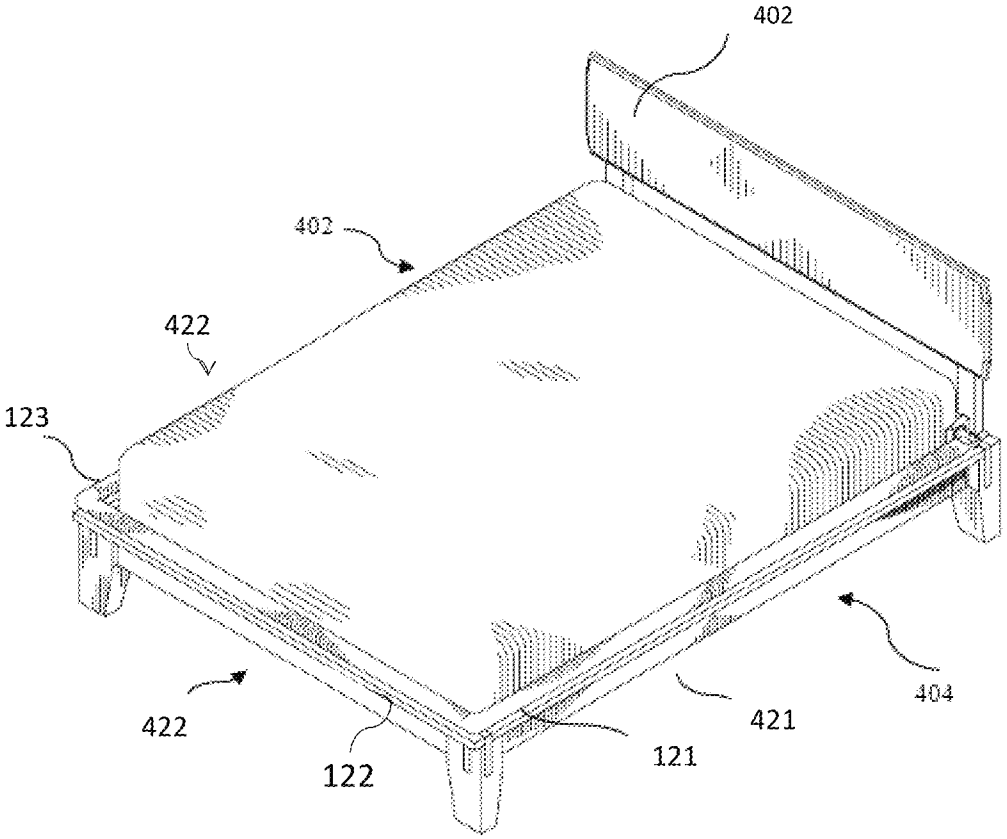
FIG. 4A is a perspective view of an earthquake protection bed system according to an embodiment.
Figure 4B:
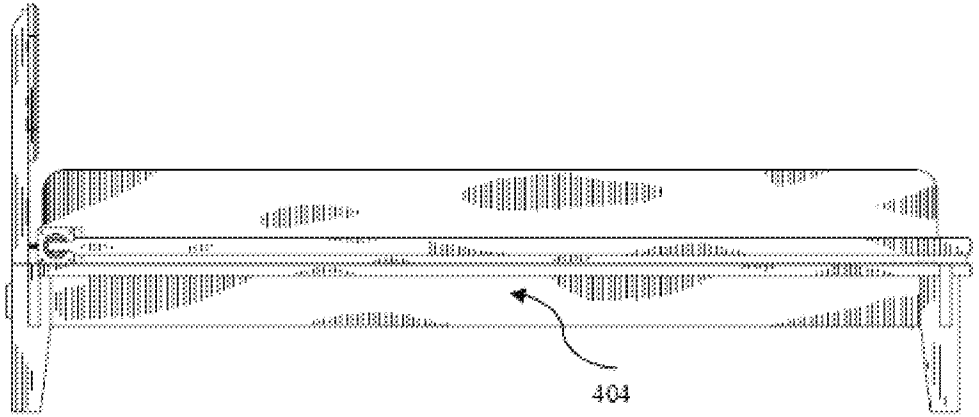
FIG. 4B is a side view of the earthquake protection bed system of FIG. 4A.
Figure 4C:
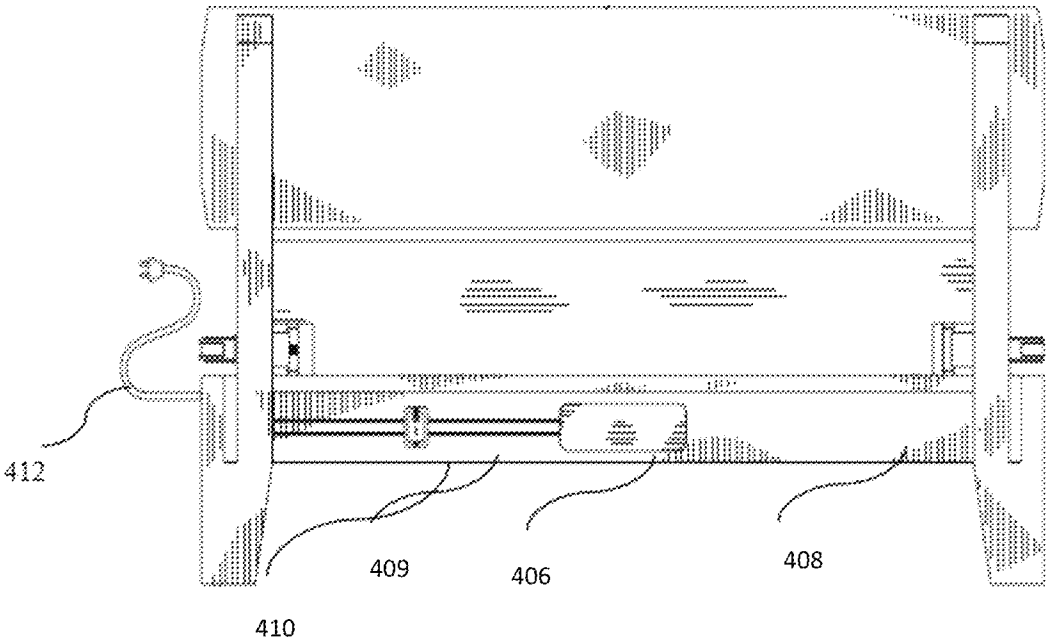
FIG. 4C is a back view of the earthquake protection bed system of FIG. 4A.
Figure 5:
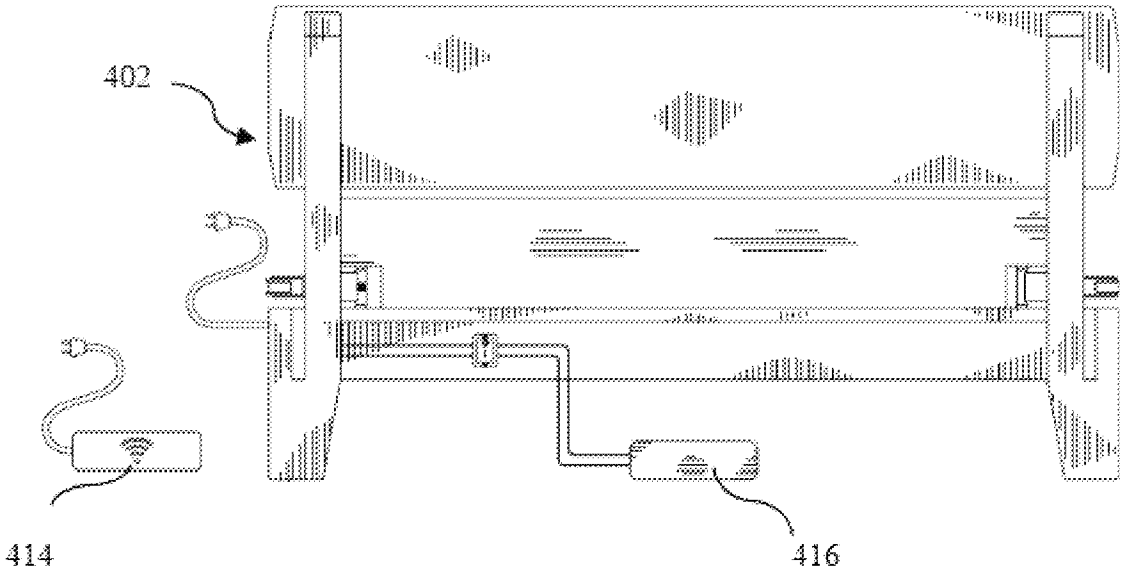
FIG. 5 is a rear view of the earthquake protection bed system of FIG. 4A activated remotely.
Figure 6A:
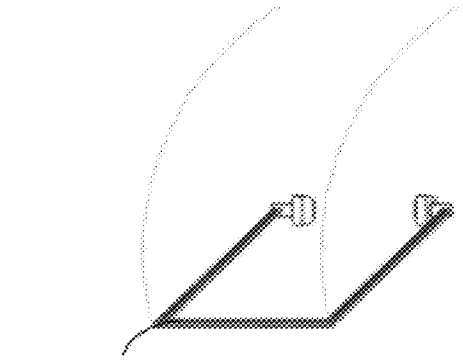
FIGS. 6A-6D are perspective views of movement of the frame of an earthquake protection system and apparatus from rest state to active state and vice versa according to an embodiment.
Figure 6B:
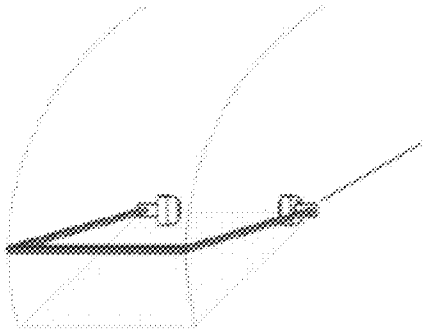
Figure 6C:
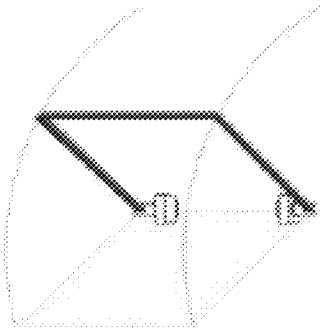
Figure 6D:
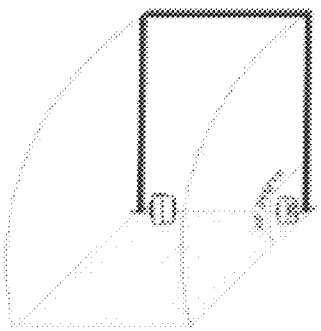
Figure 7A:
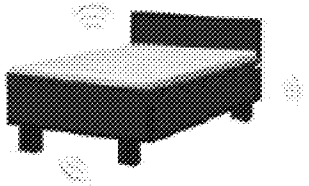
FIGS. 7A-7F are perspective views of movement of a canopy of an earthquake protection system and apparatus from rest state to active state and vice versa according to an embodiment.
Figure 7B:
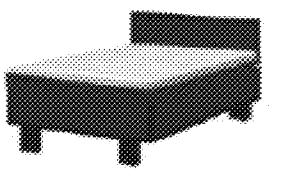
Figure 7C:
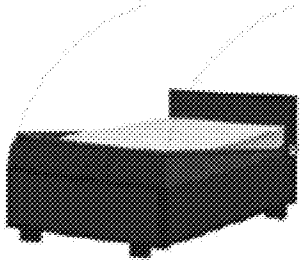
Figure 7D:
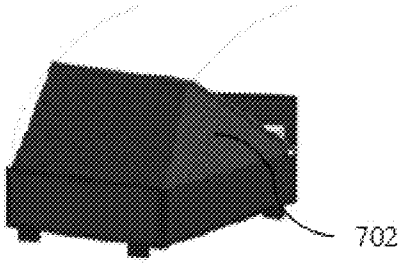
Figure 7E:
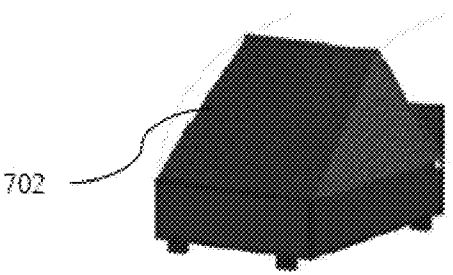
Figure 7F:
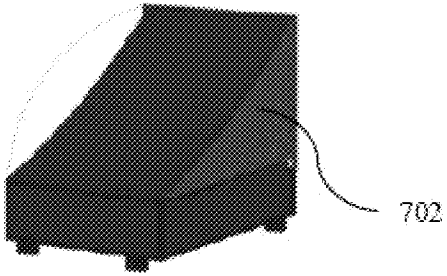

FIG. 4A shows a schematic of another embodiment of an earthquake protection bed system 400. The system 400 includes a frame 404 is deployed on the bed 402. The frame 404 and other elements related thereto have already been discussed in detail above in the embodiments of the apparatus 100. The frame 404 is deployed on the bed 402 such that the rod 121 lies along the periphery 421, the rod 122 along the periphery 422, and the rod 123 along the periphery 423 of the bed 402. FIG. 4B shows a schematic side view of the system 400, FIG. 4C and FIG. 5 show a back view of the system 400.

In another embodiment, the present disclosure discloses another schematic view of a earthquake protection bed system 400. The system 400 may include a remote sensing device 414 which may be configured remote control of activation of the motors 408, 409 through. The remote sensing device 414 may be configured to activate the motors as the remote sensing device 414 detects the seismic vibrations and may be disposed in proximity to the bed 402. There may be occurrences of false alarms and vibrations such as children jumping on bed, vibrations due to high pitch volume speakers. Hence, the motors 408, 409 may tend to trigger only when the motors 408, 409 receive signal of activation from the remote sensing device 414 and the sensor box 406, thereby distinguishing between false alarms and vibrations. In some aspects, controlling the activation of the motors 108, 109 may be automated as the motors 408, 409 receives the signals of activation from either or both of the sensor box 406, and the remote sensing device 414.

In some aspects, the motors 408, 409 may be controlled through a cloud computing platform. The cloud computing platform may include a server having an application installed therein. The server may further include seismic vibration sensor and other sensors as aforementioned. The server may further send signals of activation to the motors 408, 409 over a cloud computing interface. The server may be a smartphone, a laptop, android phone, computer, etc.

The motors 408, 409 may stop rolling the frame 404 and the material further until the unfolded material is a full canopy housing the bed 402. The motors 408, 409 tend to lower the frame 404 and the material only when the motors 408, 409 gets the instruction from either or both of the sensor box 406, and the remote sensing device 414 or the cloud computing platform when the sensor box 406, the remote sensing device 414, the cloud computing platform do not detect any more seismic vibrations. In some embodiments, rolling back of the frame 404 can be done manually.

In some aspects, the apparatus 100 is configured to be deployed on a platform exposed to casualties due to earthquake. The platform may include such as but are not limited to a mattress, vehicles such as cars, etc, buildings, offices, furniture, animal houses, and so on.

The bed includes, such as, but not limited to a single bed, a double bed, a double-decker bed, a triple-decker bed, a bunk bed, a quadruple decker bunk bed, a convertible sofa bed, an expandable bed, a foldable bed, a convertible chair bed, a convertible table bed, a hospital bed, a mounted bed, a crib, and combinations thereof. In case of such exemplary beds such as bunk beds, the aforementioned earthquake protection apparatus may be disposed on lower bed. As the apparatus gets activated, the rods may be extended telescopically to reach beyond the topmost bed, thereby housing all the beds at different heights.

Figure 8:
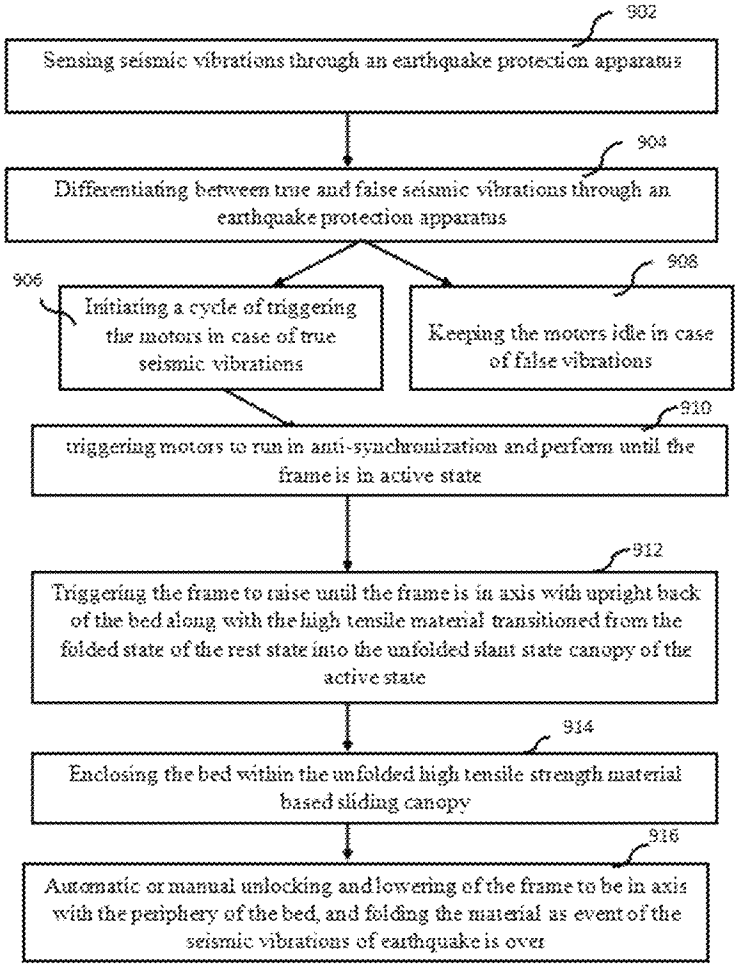
FIG. 8 shows a flowchart depicting a method 900 for operating an earthquake protection bed system activated remotely, in accordance with another illustrative embodiment of the present disclosure.

FIG. 8 is a flowchart describing a method 900 for protecting bed user(s) from casualties due to an earthquake through the earthquake protection apparatus 100 according to an embodiment to a bed is disclosed. The apparatus 900 can be activated annually and/or manually. The method 900 includes a number of steps; sequence thereof may be exemplary for understanding of the persons skilled in the art. The method 900 includes sensing seismic vibrations at step 902, followed by differentiating between true and false seismic vibrations through an earthquake protection apparatus 100 at step 904. The method 900 further involves detecting true vibration occurrences and initiating a cycle of triggering the motors 108, 109 at step 906 else remaining idle at step 908. In some aspects, the method 900 includes sensing seismic vibrations through a remote-controlled unit. The method 900 further involves triggering motors 108, 109 to run in anti-synchronization and perform until the frame 102 is in active state at step 910. The method 900 also includes triggering the frame 102 to be raised until the frame 102 is in axis with upright back of the bed along with the material transitioned from the folded state of the rest state into the unfolded state-canopy of the active state at step 912. The method 900 finally involves housing the bed via unfolded material based sliding canopy at step 914. Further, as—the motors 108, 109 deactivate, the frame 102 lowers down to be in axis with the periphery of the bed, and folding the material to be compressed beneath the frame 102 at step 916. The method 900 involves deactivating the motors 108, 109 to transition the frame 102 the rest state from the active state when the event of earthquake is over. The method 100 also involves activating the apparatus 100 through a cloud computing unit. The method 900 further includes extending rods of the frame 102 telescopically to accommodate the apparatus 100 as per size and shape of the bed. The method 900 includes extending rods of the frame 102 telescopically to accommodate the apparatus 100 as per size and shape of the bed. The method 900 includes automatic sliding of the debris off from the canopy.

The apparatus 100 having all the components except the reinforced material are made from various materials which have good tensile strength and are known well in the art, for example stainless steel, and so on. The bed can be made from any materials and of any shape or size already existing in the art.

Therefore, the aforementioned disclosed embodiments provide light weight, robust, user friendly, operative automated and manually, automatic sliding of the debris, customizable, no requirement of making suffocating drawers or boxes beneath the bed, completely safe for people especially elderly, patients, and children.

As the occurrences of events of earthquake of greater magnitude and the consequent demolishing casualties are increasing every year, there is a requirement of an anti-earthquake protection apparatus and system which is light-weight, easy to deploy and operate, automated, suitable and convenient for persons and property especially elderly, children, devoid of suffocation, adaptability to any type, size, and shape of bed, intelligent enough to discriminate between false alarms/vibrations and true alarms/vibrations, and automatic clearance of debris falling thereon, reusability, and so on.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Many modifications will be apparent to those skilled in the art without departing from the scope of the present invention as herein described with reference to the accompanying drawings.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

As used herein, the singular forms "a", "an", "the" include plural referents unless the context clearly dictates otherwise. Further, the terms "like", "as such", "for example", "including" are meant to introduce examples which further clarify more general subject matter, and should be contemplated for the persons skilled in the art to understand the subject matter.

Various illustrative logical blocks, modules, components, circuits, and algorithm operations described in connection with the aspects described herein may be implemented as electronic hardware, computer software, or combinations of both. To clearly illustrate this interchangeability of hardware and software, various illustrative components, blocks, modules, circuits, operations, etc. have been described herein generally in terms of their functionality. Whether such functionality is implemented as hardware or software depends upon the particular application and design constraints imposed on the overall system. One of skill in the art may implement the described functionality in varying ways for each particular application, but such implementation decisions should not be interpreted as causing a departure from the scope of the claims.

The hardware used to implement various illustrative logics, logical blocks, modules, components, circuits, etc. described in connection with the aspects described herein may be implemented or performed with a general purpose processor, a digital signal processor ("DSP"), an application specific integrated circuit ("ASIC"), a field programmable gate array ("FPGA") or other programmable logic device, discrete gate logic, transistor logic, discrete hardware components, or any combination thereof designed to perform the functions described herein. A general-purpose processor may be a microprocessor, a controller, a microcontroller, a state machine, etc. A processor may also be implemented as a combination of receiver smart objects, e.g., a combination of a DSP and a microprocessor, a plurality of microprocessors, one or more microprocessors in conjunction with a DSP core, or any other such like configuration. Alternatively, some operations or methods may be performed by circuitry that is specific to a given function.

In one or more aspects, the functions described may be implemented in hardware, software, firmware, or any combination thereof. If implemented in software, the functions may be stored as one or more instructions (or code) on a non-transitory computer-readable storage medium or a non-transitory processor-readable storage medium. The operations of a method or algorithm disclosed herein may be embodied in a processor-executable software module or as processor-executable instructions, both of which may reside on a non-transitory computer-readable or processor-readable storage medium. Non-transitory computer-readable or processor-readable storage media may be any storage media that may be accessed by a computer or a processor (e.g., RAM, flash memory, etc.). By way of example but not limitation, such non-transitory computer-readable or processor-readable storage media may include RAM, ROM, EEPROM, NAND FLASH, NOR FLASH, M-RAM, P-RAM, R-RAM, CD-ROM, DVD, magnetic disk storage, magnetic storage smart objects, or any other medium that may be used to store program code in the form of instructions or data structures and that may be accessed by a computer. Disk as used herein may refer to magnetic or non-magnetic storage operable to store instructions or code. Disc refers to any optical disc operable to store instructions or code. Combinations of any of the above are also included within the scope of non-transitory computer-readable and processor-readable media. Additionally, the operations of a method or algorithm may reside as one or any combination or set of codes and/or instructions on a non-transitory processor-readable storage medium and/or computer-readable storage medium, which may be incorporated into a computer program product.

The foregoing descriptions of exemplary embodiments of the present disclosure have been presented for purposes of illustration and description. They are not intended to be exhaustive or to limit the disclosure to the precise forms disclosed, and obviously many modifications and variations are possible in light of the above teaching. The exemplary embodiments were chosen and described in order to best explain the principles of the disclosure and its practical application, to thereby enable others skilled in the art to best utilize the disclosure and various embodiments with various modifications as are suited to the particular use contemplated. It is understood that various omissions, substitutions of equivalents are contemplated as circumstance may suggest or render expedient but is intended to cover the application or implementation without departing from the spirit or scope of the claims of the present disclosure.

The invention claimed is:

1. An earthquake bed protection apparatus comprising:

a canopy frame;

a reinforced material attached beneath the frame in a folded configuration in a rest state, and in an active state an unfolded configuration comprising a triangular canopy including, an apex of the triangular canopy at a position corresponding to a first end of a bed, a base of the triangular canopy at a position corresponding to a second end of the bed, and a sliding wall extending at a downward angle from the first end to the second end of the bed between the apex and the base;

a sensor box comprising a plurality of sensors, a microcontroller, and an accelerometer; and at least two motors in proximity to the canopy frame and in communication with the sensor box and disposed in proximity thereto, the motors being anti-synchronized together to move the canopy frame from the rest state to the active state.

2. The earthquake bed protection apparatus of claim 1, wherein the apparatus is configured to be removably attached to a bed.

3. The earthquake bed protection apparatus of claim 1, wherein the frame comprises a plurality of fixed rods.

4. The earthquake bed protection apparatus of claim 1, wherein the frame comprises a plurality of telescopic rods.

5. The earthquake bed protection apparatus of claim 1, wherein the motors comprise rechargeable, synchronized battery-powered motors.

6. The earthquake bed protection apparatus of claim 1, wherein the motors comprise at least one of AC/DC powered battery backed hydraulic lifts and AC/DC powered battery backed linear actuators.

7. The earthquake bed protection apparatus of claim 1, wherein the motors comprise a receiver operative to receive seismic sensory signals from the sensor box, and activate the frame to unfold the material in response to said signals.

8. The earthquake bed protection apparatus of claim 1, wherein the plurality of the sensors include one or more of a gyro sensor, accelerometer, a multi-directional tunnel movement, electrostatic capacity acceleration sensor, seismic sensors, and vibration sensors, and wherein the sensor box further comprises a system-on-chip module.

9. The earthquake bed protection apparatus of claim 1, wherein the motors are activated remotely through at least one of a wireless or wired signal.

10. The earthquake bed protection apparatus of claim 1, wherein the bed comprises at least one of a single bed, a double bed, a double decker bed, a triple decker bed, a bunk bed, a quadruple decker bunk bed, a convertible sofa bed, an expandable bed, a foldable bed, a convertible chair bed, a convertible table bed, a hospital bed, a mounted bed, and a crib.

11. The earthquake bed protection apparatus of claim 1, further comprising a wirelessly controlled unit to control the apparatus.

12. The earthquake bed protection apparatus of claim 1, wherein the canopy frame has shape corresponding to the shape of the bed and includes at least one of a curved U-shape, a right-angled U-shape, a triangular shape, an oval shape, and a circular shape.

13. The earthquake bed protection apparatus of claim 1, wherein the bed comprises a rectangular shape including the first end and the second end and two sides, wherein the sides are longer than the ends.

14. An earthquake bed protection system comprising:

a bed;

a canopy frame positioned around at least a portion of a periphery of the bed, the frame positioned to have a parallel axis with the bed in a rest state, and in a perpendicular axis to the bed in an active state;

a reinforced material attached with or enclosed around the frame in a folded configuration in the rest state, and in an unfolded configuration comprising a triangular canopy including, an apex of the triangular canopy at a position corresponding to a first end of a bed, a base of the triangular canopy at a position corresponding to a second end of the bed, and a sliding wall extending at a downward angle from the first end to the second end of the bed between the apex and the base;

at least two motors in conjunction with the frame, the motors being synchronized together to move the canopy frame from the rest state to the active state by movement in opposite directions; and a sensor box disposed in proximity to the motors, the sensor box housing one or more printed circuit boards and a plurality of sensors in communication with the motors.

15. The earthquake bed protection system of claim 14, wherein the frame transitions from the rest state to the active state, and vice versa.

16. The earthquake bed protection system of claim 14, wherein the system is reusable.

17. The earthquake bed protection system of claim 14, wherein the material is reinforced to bear a load of debris falling due to earthquake.

18. The earthquake bed protection system of claim 14, further comprising a remote sensing device in proximity to the bed, the device differentiates between actual and proxy tremors to accurately detect an earthquake.

19. The earthquake bed protection system of claim 14, wherein the canopy frame has shape corresponding to the shape of the bed and includes at least one of a curved U-shape, a right-angled U-shape, a triangular shape, an oval shape, and a circular shape.

20. The earthquake bed protection system of claim 14, wherein the bed comprises a rectangular shape including the first end and the second end and two sides, wherein the sides are longer than the ends.

* * * * *